US006250235B1

(12) United States Patent
Oehr et al.

(10) Patent No.: US 6,250,235 B1
(45) Date of Patent: Jun. 26, 2001

(54) METHOD AND PRODUCT FOR IMPROVED FOSSIL FUEL COMBUSTION

(75) Inventors: Klaus H. Oehr, Surrey; Felix Z. Yao, Vancouver, both of (CA)

(73) Assignee: Global New Energy Technology Corporation, St. Michael (BB)

( * ) Notice: Subject to any disclaimer, the term of this patent is extended or adjusted under 35 U.S.C. 154(b) by 0 days.

(21) Appl. No.: 09/629,872

(22) Filed: Aug. 1, 2000

(30) Foreign Application Priority Data

Jul. 26, 2000 (CA) ..... 2314566

(51) Int. Cl.[7] ..... F23B 7/00

(52) U.S. Cl. ..... 110/342; 110/218; 110/346; 110/347; 110/345

(58) Field of Search ..... 110/218, 341, 110/342, 344, 345, 347, 346

(56) References Cited

U.S. PATENT DOCUMENTS

| | | | | |
|---|---|---|---|---|
| 3,884,678 | * | 5/1975 | Iyengar | 75/52 |
| 4,191,115 | * | 3/1980 | Yang et al. | 110/347 |
| 4,943,233 | * | 7/1990 | Diaz | 432/13 |
| 5,243,922 | * | 9/1993 | Rehmat et al. | 110/233 |
| 5,517,930 | * | 5/1996 | Farwick et al. | 110/345 |
| 5,615,626 | * | 4/1997 | Floyd et al. | 110/346 |
| 5,992,336 | | 11/1999 | Ramme . | |

OTHER PUBLICATIONS

Aarna, I. and E.M. Suuberg, "The Role of Carbon Monoxide in the NO–Carbon Reaction", Energy & Fuels 1999, vol. 13, pp. 1145–1153.

Chase, M.W., et al., "JANAF Thermochemical Tables", Third Edition, Parts I and II. Journal of Physical and Chemical Reference Data, American Chemical Society and the American Institute of Physics for the National Bureau of Standards, vol. 14, 1985, Supplement No. 1.

Edmunds, D.M. and J. Taylor, "Reaction $CaO=3C+CaC_2+CO$ and Activity of Lime in $CaO–Al_2O_3–CaF_2$ System", Journal of the Iron and Steel Institute, vol. 210, Part 4, Apr., 1972 pp. 280–283.

Eitel, W., *The Physical Chemistry of the Silicates*, The University of Chicago Press, pp. 559, 649–650, 673–674, 678, 730, 774, 786, 790, 794, 815–816, 824, 1046, 1096, 1189–1190, 1192, 1400–1402, 1413, 1416, 1427, 1430.

Eitel, W., *Silicate Science*, vol. V, Ceramics and Hydraulic Binders, Academic Press, 1966, pp. 325–328, 398–401, 408–413, 421–425, 427–431, 435–438, 442–446, 448–449, 604–615, 630–637, 643–649.

Fine, H.A., and Gaskell, D.R., editors, "Second International Symposium on Metallurgical Slags and Fluxes" The Metallurgical Society of AIME, pp. 444–445.

Frady, W.T., J.G. Keppeler, and J.C. Knowles, "South Carolina Electric & Gas Successful Application of Carbon Burn–out at the Wateree Station", 1999 International Ash Utilization Symposium Commercial Ash Processing—a User's Perspective. http://www.electricfuels.com/cbo–paper.html pp. 1–2.

Gopalakrishnan, R., M.J. Fullwood, and C.H. Bartholomew, "Catalysis of Char Oxidation by Calcium Minerals: Effects of Calcium Compound Chemistry on Intrinsic Reactivity of Doped Spherocarb and Zap Chars", Energy & Fuels, 1994, vol. 8, No. 4, pp. 984–989.

Gopalakrishnan, R. and C.H. Bartholomew, "Effects of Cao, High–Temperature Treatment, Carbon Structure, and Coal Rank on Intrinsic Char Oxidation Rates", Energy & Fuels 1996, vol. 10, No. 3, pp. 689–695.

Illan–Gomez, M., et al. "NO Reduction by Activated Carbons. 4. Catalysis by Calcium", Energy & Fuels 1995, vol. 9, No. 1, pp. 112–118.

Malhotra, V.M., and P.K. Mehta, "Pozzolanic and Cementitious Materials", Advances in Concrete Technology, vol. 1, Gordon and Breach Publishers, pp. 1–34, 157–171, 173–182.

McLennan, A.R., et al., "Ash Formation Mechanisms during pf Combustion in Reducing Conditions", Energy & Fuels 2000, vol. 14, No. 1, pp. 150–159.

McLennan, A.R., et al., "An Experimental Comparison of the Ash Formed from Coals Containing Pyrite and Siderite Mineral in Oxidizing and Reducing Conditions", Energy & Fuels 2000, vol. 14, No. 2, pp. 308–315.

Naik, T.R., et al., "Properties of high performance concrete systems incorporating large amounts of high–lime fly ash", Construction and Building Materials 1995, vol. 9, No. 4, pp. 195–204.

Sarma, B., et al., "Reduction of FeO in Smelting Slags by Solid Carbon: Experimental Results", Metallurgical and Materials Transactions B, vol. 27B, Oct. 1996, pp. 717–730.

Simons, G.A., "Parameters Limiting Sulfation by CaO" American Institute of Chemical Engineering Journal, vol. 34, No. 1, Jan. 1988, pp. 167–170.

Song, Hyo–Soek, et al., "Thermodynamic behaviour of carbon in $CaO–SiO_2$ slag system", Steel Research, vol. 70, 1999, No. 3, pp. 105–109.

(List continued on next page.)

*Primary Examiner*—Denise L. Ferensic
*Assistant Examiner*—K. B. Rinehart
(74) *Attorney, Agent, or Firm*—Hall, Priddy, Myers & Vande Sande

(57) ABSTRACT

A method of treating a fossil fuel for combustion, which includes heating the fossil fuel and an additive in a combustion zone. The additive contains a lime flux that lowers the melting point of lime sufficiently so that lime in the combustion zone melts wholly or partially. The additive reacts with the fossil fuel char and its sulphur plus ash components, in the combustion zone to achieve the following results alone or in combination: accelerated combustion, desulphurization, nitrogen oxides emission reduction, pozzolanic or cementitious product production or combustor anti-fouling.

53 Claims, No Drawings

OTHER PUBLICATIONS

Ueda, S. and M. Maeda, "Phase–Diagram Study for the $Al_2O_3$–$CaF_2SiO_2$ System", Metallurgical and Materials Transactions B, vol. 30B, Oct. 1999, pp. 921–924.

Ward, R.G., *An Introduction to the Physical Chemistry of Iron & Steel Making*, Edward Arnold (Publishers) Ltd., pp. 100–101.

Waseda, Y. and J.M. Toguri, *The Structure and Properties of Oxide Melts: Application of Basic Science to Metallurgical Processing*, World Scientific, pp. 1, 113–129, 138–141, 159–165.

Weast, R.C., and M.J. Astle, Editors, CRC Handbook of Chemistry and Physics, 63rd Ed., CRC Press, Inc., pp. B–86–B–89, B–109.

Zaitsev, A.I., et al., "Thermodynamic Properties and Phase Equilibria in the $CaF_2$–$SiO_2$–$Al_2O_3$–CaO System: II. Thermodynamic Modeling of $CaF_2SiO_2$–$Al_2O_3$–CaO Melts", Inorganic Materials, vol. 34, No. 1, 1998, pp. 66–74.

Zaitsev, A.I., et al., "Thermodynamic of CaO–$Al_2O_3$–$SiO_2$ and $CaF_2$–CaO–$Al_2O_3$–$SiO_2$ Melts", Journal of the Chemical Society, Faraday Transactions, 1997, vol. 93, No. 17, pp. 3089–3098.

Zhang, Z.–G., et al., "Successive Pulsing of an Iron–Loaded Canadian Subbituminous Coal Char", Energy & Fuels 1994, vol. 8, No. 4, pp. 943–946.

* cited by examiner-

METHOD AND PRODUCT FOR IMPROVED FOSSIL FUEL COMBUSTION

FIELD

The present invention relates to a method of fossil fuel combustion.

BACKGROUND

Acid rain is a problem throughout the world. Acid rain affects the environment by reducing air quality, rendering lakes acid and killing vegetation, particularly trees. It has been the subject of international dispute. Canada and the United States have argued over the production of acid rain. European countries are other antagonists.

In the main, acid rain stems from sulphur dioxide produced in smoke stacks. The sulphur dioxide typically originates from the sulphur containing fuel, for example coal. The sulphur dioxide is oxidized in the atmosphere to sulphur trioxide and the sulphur trioxide is dissolved to form sulphuric acid. The rain is thus made acidic. The oxides of nitrogen are also a factor in producing acid in the atmosphere. Millions of tons of oxides of nitrogen are fed to the atmosphere each year.

With the passage of international clean air acts, such as issued in the United States in 1990, the reduction of acid emissions has become a priority. Planners for electrical utilities in particular are developing strategies for reducing emissions of sulphur dioxide and nitrogen oxides in the production of electrical and thermal power. The majority of fossil fuel used in power production contains sulphur which produces sulphur dioxide and hydrogen sulphide during combustion.

In an effort to improve economics for electric power production from coal and production of concrete, as well as eliminate metal containing solid waste discharges to landfills, there is an increasing desire to recycle the ash combustion products of fossil fuel combustion, especially that related to char or coal combustion.

Naik et al (ref. 14) describes the beneficial effects of low carbon content coal ash on the performance of concrete. High calcium containing coal ash was successfully used to replace up to 50% of Portland cement in concretes with a variety of enhanced properties including improved durability such as cracking resistance.

Malhotra and Mehta (ref. 11) indicated that "Portland cement is the most energy-intensive component of a concrete mixture, whereas pozzolanic and cementitious by-products from thermal power production and metallurgical operations require little or no expenditure of energy. Therefore, as a cement substitute, typically from 20% to 60% cement replacement by mass, the use of such by-products in the cement and concrete industry can result in substantial energy savings. Concrete mixtures containing pozzolanic and cementitious materials exhibit superior durability to thermal cracking and aggressive chemicals. This explains the increasing worldwide trend toward utilization of pozzolanic and cementitious materials either in the form of blended portland cements or as direct additions to portland cement concrete during the mixing operation." These authors classify ash products as follows:

Pozzolans—"A pozzolan is a siliceous or siliceous and aluminous material, which itself possesses little or no cementitious property but which will in finely divided form and in the presence of moisture, chemically react with calcium hydroxide at ordinary temperature to form compounds possessing cementing properties."

Cementitious—"there are some finely divided and non-crystalline or poorly crystalline materials similar to pozzolans but containing sufficient calcium to form compounds which possess cementing properties after interaction with water. These materials are classified as cementitious."

Ramme in U.S. Pat. No. 5,992,336 (ref. 15) indicated that "a principal reason for the lack of commercial value for coal ash is the presence of unburned carbon in the ash (page 1, lines 18–20). He describes "reburning" of coal ash as the only cost effective alternative to reducing carbon content of coal ash.

Frady et al (ref. 7) also describe a process for upgrading the pozzolanic value of ash using a fluidized bed ash reburning process to reduce its carbon content. They acknowledged a desire to promote the use of coal ash in concrete production. They indicated that without their ash reburning technology "ash carbon content was marginal at best and non-saleable to the concrete market at worst". In addition they "recognized that changes in combustion conditions designed to meet low NOx regulations would lead to a further diminishment in fly ash quality. As quality was already marginal at several stations, further diminishment would essentially shut this fly ash out of the local concrete market, which was strong and growing."

Gas desulphurization systems are known. The majority rely on simple basic compounds such as calcium carbonate, calcium oxide or calcium hydroxide, to react with the acidic sulphur containing species to produce non-volatile products such as calcium sulphite and calcium sulphate.

Conventional alkaline adsorbents such as calcium carbonate and calcium hydroxide undergo thermal decomposition to calcium oxide at high temperature, which results in the chemical reaction of calcium oxide with sulphur dioxide. However, the adsorbents suffer from a number of problems:

a) Fouling of exterior solid surfaces by calcium sulphite or calcium sulphate;

b) Absorption of heat due to evolution of carbon dioxide (from calcium carbonate) or steam (from calcium hydroxide) resulting in lower furnace temperatures, reduced rates of fossil fuel burning, reduction of furnace power output per unit of fuel input;

c) Desulphurization is restricted to the "post flame combustion region" which is associated with the "sintering" or "collapse" of calcium oxide crystals at temperatures of about 1200° C. resulting in a loss of their porosity. Loss of lime porosity is clearly identified by the Simons reference (see ref. 17) as highly detrimental to sulphur dioxide adsorption;

d) The desulphurization is restricted to the formation of calcium sulphate or calcium sulphite;

e) The lime/sulphur reaction which occurs in the gas-solid state, in the post combustion zone is slow, resulting in inadequate sulphur dioxide removal and inadequate residence times for sulphur dioxide removal. The lime sintering problem therefore requires precise narrow temperature region injection of the reagent e.g. <1200° C.; and f) No byproduct ash recycling in a value-added form is possible. In fact the ash is contaminated with a calcium sulphate byproduct contaminated with unreacted internal lime which results in an undesirable landfill problem due to residue alkalinity.

This technique for desulphurization has not been accepted to any degree by the coal-fired power industry.

The prior art has described laboratory experiments with respect to catalytic destruction of NOx. For instance, Illán-Gómez et al. (ref. 10) investigated the catalytic destruction of NO on carbon surfaces in the presence of Cao. They indicated that well dispersed CaO formed upon pyrolysis of lignite coals was found to be efficient in both in-situ sulphur capture and NOx reduction. They described the effectiveness of calcium loaded carbon in NOx reduction in the presence of molecular oxygen $O_2$. The catalytic role of calcium was found to be analogous to the role it has in carbon gasification, that of increasing the concentration of carbon-oxygen complexes on the carbon surface.

Aarna and Suuberg (ref. 1) demonstrated the enhancement of NO reduction on coal char by CO. They described reports concerning the catalysis of the following reaction by various types of surfaces including calcined limestone (CaO) and CaO used in sulphur retention:

$$NO+CO=\tfrac{1}{2}N_2+CO_2$$

The steel industry has described techniques for desulphurization in molten alkaline CaO environments.

For instance, Ward (ref. 20) summarized conditions for optimum desulphurization via oxide melts:

a) High CaO content;

b) Low temperature;

c) A fluid slag this is promoted by $CaF_2$ additions and avoiding excessively high slag acidities or operation below the melting point of the slag;

d) $CaF_2$ additions—these not only increase fluidity, but also increase the fundamental rate of the desulphurization reaction; and e) Stirring in the bath due to gas bubbles.

The prior art have described laboratory experiments involving impregnation of devolatilized chars including coal chars, with CaO precursors such as calcium containing salt solutions, such as calcium acetate, to increase char combustion rates. The steel industry has illustrated the impact of molten CaO containing mixtures on carbon containing char oxidation rates of interest to that industry.

For instance, Sarma et al. (ref. 16) showed that $CaO—SiO_2—Al_2O_3—FeO$ slags react with char at 1400 to 1450° C. to generate CO. Reaction rate increased with increasing FeO content of slag. A gas film formed between the slag and the surface. $CaO/SiO_2$ weight ratio was unity. The diffusion of $Fe^{2+}$ and $O^{2-}$ ions from the bulk of the slag to the slag-gas interface is at least one of the rate limiting steps for the overall reduction reaction.

$$C+FeO=Fe+CO$$

$$FeO+CO=Fe+CO_2<1535 \text{ Celsius}$$

$$CO_2+C=2CO$$

$$Fe+C=FeC$$

Gopalakrishnan et al. (ref. 9) showed the catalytic oxidation of char by CaO, $CaCO_3$ and $CaSO_4$ at 1200° C. The results indicated significant catalytic effects of up to 2700 times for CaO, 160 times for $CaCO_3$ and 290 times for $CaSO_4$. Oxidation rate increased with increasing CaO loading in char pores.

Song et al. (ref. 18) described the thermodynamic behaviour of carbon in $CaO—SiO_2$ slags. They implied a carbon reaction mechanism involving reaction of carbon with oxygen ions supplied from CaO in the slag. The solubility of carbide in $CaO.SiO_2$ slag increased with addition of $CaF_2$. It was speculated that the presence of fluoride ions increased CaO basicity (electronegativity) by depolymerizing silicate ion networks via replacement of polymer bridging oxygen ions with non-polymer bridging fluoride ions.

The dissolution mechanism for carbon was expressed as follows:

$$nC+mO^{2-}=C_n^{2m-}+m/2O_2$$

where $C_n^{2m-}$ represents carbide or in the form of complex ion of carbonate e.g.

$$C+O^{2-}=C^{2-}+1/2O_2$$

$$2C+O^{2-}=C_2^{2-}+1/2O_2$$

$$C+1/2O_2=CO$$

Overall:

$$3C+CaO=CaC_2+CO$$

$$CaC_2+3/2O_2=CaO+2CO$$

Molten CaO has therefore been demonstrated as a catalyst for the oxidation of carbon to CO via formation of an ionized calcium carbide intermediate. This latter reaction is based on the solubility of carbon increasing with increasing slag basicity. Carbon solubility was found to increase with increasing temperature.

Gopalakrishnan and Bartholemew (ref. 9) determined the effect of CaO with respect to carbon structure and coal rank on char oxidation rates. They indicated that catalysis of char oxidation by CaO is an accepted fact and that char oxidation in the presence of CaO increased with decreasing char "skeletal density". They indicated that CaO catalyzes gasification by $O_2$, $CO_2$ and $H_2O$ of low-rank coal chars and that the importance of well-dispersed CaO and intimate carbon-CaO contact is well established. They investigated quantitatively the effect of calcium oxide catalysis on the reactivity of Dietz sub-bituminous coal char prepared under high-temperature conditions representative of pulverized coal combustion.

Zhang et al. (ref. 23) demonstrated the effect of iron oxides such as $Fe_2O_3$ and FeO in the catalytic gasification of sub-bituminous coal chars in the presence of carbon dioxide as follows:

$$FeO+C=Fe+CO$$

$$Fe_2O_3+C=2FeO+CO$$

$$CO_2+Fe=FeO+CO$$

$$CO_2+2FeO=Fe_2O_3+CO$$

Overall:

$$C+CO_2=2CO$$

The prior art has described the beneficial effect of fluoride in CaO containing melts of interest to the steel industry. For instance, Zaitsev et al. (ref. 21) describe the thermodynamic properties and phase equilibria for $CaF_2—SiO_2—Al_2O_3—CaO$ melts. This reference clearly describes the polymerization/depolymerization behaviour of silica as silicates in silica containing melts e.g. $SiO_2$ forms $Si_3O_9^{6-}$, $Si_6O_{18}^{-12}$ and so on. The Zaitsev reference indicates that the following reaction is possible in $CaF_2—CaO—Al_2O_3$ melts:

$$CaO_{melt}+3C_{solid}=CaC_2+CO$$

Zaitsev et al. (ref. 22) further indicate species present in $CaF_2—CaO—Al_2O_3—SiO_2$ melts where the following abbreviations are used C=CaO, A=$Al_2O_3$, S=$SiO_2$. They indicated that the $CaF_2$—CaO-$Al_2O_3$—$SiO_2$ melt consisted of monomer, associative and polymer species. Associative species include:

CA, $C_2S$, CS, AS, $C_2AS$, CAS and $CAS_2$

Polymer species include $SiO_2$ networks connected with AS (e.g. $AS_y$ where $y \geqq 2$) or CAS (e.g. $CAS_z$ where $y \geqq 2$)).

Ueda and Meda (ref. 19) described the behaviour of $CaF_2$ in the presence of silicates. They indicated that $CaF_2$ decreases the melting point of a mixture of calcium oxide and silicates and thereby increases its reactivity. This reference indicated that a small amount of $Al_2O_3$ in a CaO—$CaF_2$ mixture improved the ability of $CaF_2$—CaO to dissolve $SiO_2$.

Edmunds and Taylor (ref. 3) described the kinetics of the reaction between CaO—$Al_2O_3$—$CaF_2$ melts and carbon. These authors showed that CaO—$Al_2O_3$—$SiO_2$ or CaO—$Al_2O_3$ melts react with graphitic carbon via the following reaction:

$$CaO+3C=CaC_2+CO$$

This reference allows shows that $CaC_2$ is soluble in molten $CaF_2$ (e.g. 0.22 moles $CaC_2$ with 0.78 moles $CaF_2$ at 1500° C.)

The prior art has studied combustor fouling properties associated with the inorganic iron, sulphur and ash components of coals. For instance, McLennan et al. (ref. 12) have indicated that North American coals contain iron predominantly in the form of pyrite $FeS_2$. Asian coals have iron mainly in the form of siderite $FeCO_3$. McLennan et al. described the decomposition of iron containing species in coal including pyrite $FeS_2$ and siderite $FeCO_3$. They suggested that included $FeS_2$ particles embedded in char would be exposed to a reducing environment even though the external char surfaces could be exposed to oxidizing conditions. Therefore, oxidation of "occluded" or "included" FeS in char generated by thermal decomposition of "occluded" $FeS_2$ would not proceed to any great extent until the completion of char combustion. This delay in the oxidation of "included" $FeS_2$ or FeS accounted for the significant number of Fe—O—S ash particles of high FeS content identified for oxidizing combustion geometry. Ash particles derived experimentally from high pyrite containing coals were found to have high FeS content for this reason even under oxidizing conditions. They concluded that "exposed" or "excluded" $FeS_2$ decomposes to FeS, then oxidizes from the surface inward to produce a molten FeO—FeS phase at 1080° C., which will oxidize to $Fe_3O_4$ and $Fe_2O_3$ under oxidizing conditions, but remain as FeO—FeS under reducing conditions. "Included $FeS_2$ may behave as for excluded pyrite if there is no contact with aluminosilicates, though oxidation will be delayed by char combustion. Included pyrite that contacts aluminosilicate materials will form two phase FeS/Fe-glass ash particles, with incorporation of iron into the glass as the FeS phase is oxidized. This delay in glass formation is expected to be accentuated by reducing conditions." In a subsequent reference, McLennan et al. (ref. 13) studied pulverized combustor fouling effects due to sticky iron containing deposits derived from iron containing coals. They concluded the following:

a) Although high iron levels in a coal have often been associated with ash deposition and slagging (fouling), they are not definitive with respect to potential for such behaviour;

b) Whether iron mineral is predominantly in the form of pyrite $FeS_2$ or siderite $FeCO_3$ is "included" or "excluded" nature, is closely associated with included silicate and aluminosilicate minerals, and the combustion conditions to which it is subject are important factors when considering such minerals potential for ash deposition and slagging;

c) Coals containing pyrite mineral have the potential to produce ash deposition and slagging at lower temperatures than do coals containing siderite material;

d) Under reducing conditions coals containing iron minerals pyrite and siderite have the potential to produce ash deposition and slagging problems at lower temperatures than for oxidizing conditions; and e) For air staged combustion (see above discussion on Low NOx burners), where reducing conditions exist in the lower regions of the furnace, the potential for deposition and slagging due to molten ash particles will be greater than that for conventional combustion under oxidizing conditions. Based on the melting temperatures of the ash formed, the increase in ash deposition and slagging will be greatest for pyrite containing coals, moderate for coals with a high degree of mineral association, and slight for siderite containing coals.

The prior art has studied factors impacting "stickiness" or "non-stickiness" related to the viscosities of melts associated with iron silicate and iron aluminosilicate chemistry in the presence and absence of alkali such as CaO. For instance, Waseda and Toguri (ref. 24) have described the structure and properties of oxide melts, especially those relating to viscosity. "General features are that the viscosity of oxide melts decrease with increasing temperature and the ratio of network modifier component to network former one, reflecting the situation of silicate anions which consist of a flow unit. Viscosity of oxide melts is influenced primarily by the content of network former which give large complex anions. Silicate is a typical network former that has $SiO_4^{4-}$ as its fundamental structural unit. Viscosity is intimately related to the size and shape of the silicate anions. The fundamental structural unit can undergo a series of polymerization reactions as the silica content of the melt increases. The so-called basic oxides which act as network modifiers lower the viscosity of melts by breaking the bridge in the Si—O network structure. This makes the anionic structural units of silicates smaller, resulting in a decrease in the viscosity of silicate melts." These authors described the effect of fluoride substitution on the viscosity of CaO—$SiO_2$ melts. They stated that fluorides lower the viscosity about twice as much as CaO. They also described the viscosity of FeO—$SiO_2$ melts. As expected, the viscosity of FeO—$SiO_2$ melts rises as the $SiO_2$/FeO ratio increases. For FeO—$SiO_2$ mixtures, decreases in viscosity were observed for all melts upon the addition of CaO. The decrease is more prominent for high silica melts, which suggests that CaO modifies the Si—O bonds rather than the FeO bonds.

In summary the prior art has identified the following factors relevant to fossil fuel combustion, especially that related to coal combustion:

a) CaO—$SiO_2$—$Al_2O_3$—FeO slags react with char to produce CO and with reaction rate increasing with increasing FeO content;

b) CaO, $CaCO_3$ or $CaSO_4$ catalytically enhance char combustion rates by 2700, 190 and 290 times respectively if they are in intimate contact with char. Molten CaO and other Ca containing species including $CaF_2$, $CaSO_4$ etc. are clearly catalysts for oxidation of coal carbon to CO via ionized calcium carbide formation $CaC_2$. Achieving intimate contact between the molten Ca species is stressed again and again as the key to maximizing the benefit of this desirable catalytic effect. Well dispersed CaO, especially in the presence of CO has been found to be efficient in both sulphur capture and NOx reduction e.g. NO and $N_20$ reduction. Optimum desulphurization in oxide melts such as those containing CaO are enhanced in the presence of $CaF_2$ and stirring of the melts due to gas evolution (e.g. CO gas evolution). $CaF_2$ enhances the reactivity of CaO melts by reducing their viscosity and increasing their reactivity especially in the presence of FeO and/or $SiO_2$ or their melts;

c) CaO or $CaO/CaF_2$ containing melts have the ability to eliminate or reduce fouling problems due to sticky $FeO—Al_2O_3—SiO_2$ containing melts derived from pyrite $FeS_2$ or siderite $FeCO_3$ containing coals in pulverized coal combustors due to their ability to depolymerize silicates thereby making them less viscous (non-sticky);

d) $CaF_2$ solubilizes CaO/C decomposition products i.e. $CaC_2$ thereby indirectly increasing catalytic C oxidation via CaO; and e) Current low NOx combustor technology is incompatible with the production of valuable low carbon pozzolanic and/or cementitious ash for purposes of concrete production due to undesirable unburned carbon levels in the ash.

The prior art however, especially related to coal combustion technology, has failed to incorporate knowledge derived in the steel industry to its requirements. Furthermore, its attempts to use the desirable effects of CaO have been restricted to impregnation of devolatilized coals in laboratory experiments with calcium containing aqueous solutions. Clearly this method of impregnation is unsuitable for anything but devolatilized char containing combusted coal ash. The prior art has failed to reveal how its problems related to ash fouling, desulphurization, NOx control and ash recycling can be solved simultaneously using simple and cost effective techniques which eliminate the current apparent requirement for ash reburning.

Accordingly, it is an object of the current invention to provide an improved method for the achievement of one or more of the following objectives:

a) enhanced coal combustion, especially under Low NOx combustor operating conditions;

b) enhanced acid emission reduction due to desulphurization;

c) maximization of the pozzolanic or cementitious value of fossil fuel ash, especially coal ash;

d) enhanced ability to use a wider variety of coals or chars for production of pozzolanic or cementitious ash by-products, especially those currently unsuitable for use due to unburned carbon contents;

e) minimization or elimination of combustor fouling due to combustor operation under Low NOx operating conditions especially in cases where iron rich coal or char containing siderite $FeCO_3$ or pyrite $FeS_2$ is present; and f) potential recycling of low-value or land filled high carbon ash in a novel, more cost effective process in a manner which enriches its calcium content thereby dramatically increasing its cementitious or pozzolanic value.

SUMMARY OF THE INVENTION

The current invention relates to the enhanced combustion of coal or carbon containing char in combustion zones by alkaline calcium containing material in a form able to resist or avoid sintering and resulting in lower NOx and SOx emissions and the formation of low carbon calcium enriched fly ash and bottom ash suitable for use in the manufacture of concrete or cement. The current invention further relates to eliminating or drastically reducing combustor fouling problems due to "sticky" ash deposits via alteration of ash chemical and physical properties such as viscosity due to the use of the above mentioned alkaline calcium containing material.

According to the invention there is provided a method of treating fossil fuel, especially coal or char, for combustion, which includes heating the fossil fuel and an additive, together with lime, in a combustion zone. The additive contains a lime (CaO) flux that lowers the melting point of lime sufficiently so that lime in the combustion zone melts wholly or partially.

The molten portion of the wholly or partially melted lime can penetrate cavities in the char or coal especially during or after volatilization of the coal or char volatiles thereby "flooding" ash and or char sulphur containing materials. The molten lime composition can wet and/or dissolve both coal sulphur species, carbon and coal ash species during combustion. This molten lime-carbon-ash mixture can melt additional unmelted lime, to allow additional penetration of the burning coal or char particle. The additive, in combination with lime, thereby effects simultaneous desulphurization, NOx reduction and accelerated coal or char combustion. The chemistry of the additive "lime flux" can be adjusted over a wide range to complement coal or char chemistry, iron chemistry, sulphur chemistry and the viscosities of lime-flux-char/coal ash-sulphur-iron chemistry to minimize combustor fouling problems due to "sticky" deposits such as iron silicates or iron-aluminosilicates.

Preferably, the fossil fuel contains sulphur species that consists of one or more of sulphur dioxide, sulphites, sulphides, and sulphur.

The additive may contain lime in its reacted or unreacted form (e.g. CaO or CaO reaction products of the type described in Table 1 below or others) It may react with at least one of the sulphur species in the combustion zone.

The additive may cause reduction in $NO_x$ emissions, where NOx is $N_2O$ or NO.

It may cause accelerated coal combustion and/or a reduction in combustor fouling due to sticky deposits.

Finally, the additive may cause the formation of pozzolanic or cementitious by-products.

DETAILED DESCRIPTION

A preferred embodiment fires single or multiple synthetic or naturally occurring materials able to melt lime, i.e. "lime fluxes", in whole or part, at temperatures typical of furnace injectors such as coal furnace injectors and/or combustion zones in a furnace such as a coal furnace, preferably in powdered or, possibly, liquid form, and, preferably, while in contact with powdered coal. Examples of such materials, known as "lime fluxes", are well known in the non-fossil fuel combustion industry and include minerals shown in Table 1 below (note w,x,y,z values indicate that differing ratios of ingredients are possible to achieve approximately similar melting points. Numbers under the "Reference" column are page numbers in the cited reference):

TABLE 1

| Material | Melting Point Degrees Celsius | Reference |
|---|---|---|
| $B_2O_3$ | 450 | Eitel 815 |
| $wFe.xFeS.yFeO.zFe_3O_4$ | 950 | Eitel 1430 |
| $xSiO_2.yFeO.zAl_2O_3$ | 970 | Eitel 774 |
| $CaO.2B_2O_3$ | 986 | CRC |
| $xFeO.yFeS.zSiO_2$ | 1000 | Eitel 1427 |
| $CaO.P_2O_5$ | 1000 | Eitel 824 |
| $CaO.B_2O_3.37\%\ SiO_2$ | 1002 | Eitel 816 |
| $8\%\ Al_2O_3.55\%\ CaF_2.37\%\ SiO_2$ | 1032 | Ueda 922 |
| $70\%\ FeS.30\%\ FeO$ | 1040 | Eitel 1427 |
| $xFeS.yFeO$ | 1080 | McLennan 158 |
| $wCaO.xAl_2O_3.ySiO_2.zCaF_2$ | 1081+ | Zaitsev 70 |
| $xCaO.yFeO$ | 1103+ | Fine 444 |
| $8\%\ Al_2O_3.46\%\ CaF_2.46\%\ SiO_2$ | 1110 | Ueda 922 |
| $3\%\ Al_2O_3.47\%\ CaF_2.50\%\ SiO_2$ | 1122 | Ueda 922 |
| $10\%\ Al_2O_3.40\%\ CaF_2.50\%\ SiO_2$ | 1151 | Ueda 922 |
| $55\%\ CaF_2.45\%\ SiO_2$ | 1167 | Ueda 922 |
| $FeS_2$ | 1171 | CRC |
| $2FeO.SiO_2$ | 1177 | Eitel 673 |
| $45\%\ CaO.SiO_2$— $55\%\ CaO.Fe_2O_3$ | 1185 | Eitel 790 |
| FeS | 1193 | CRC |
| $xCaO.yFe_2O_3$ | 1200 | Eitel 1190 |
| $2FeO.SiO_2$ | 1205 | Eitel 674 |
| $CaO.FeO.SiO_2$ | 1208 | Eitel 678 |
| $2FeO.Al_2O_3.5SiO_2$ | 1210 | Eitel 774 |
| $Ca_2P_2O_7$ ($2CaO.P_2O_5$) | 1230 | CRC |
| $CaO.Fe_2O_3$ | 1250 | CRC |
| $wCaO.xFe_2O_3.yAl_2O_3.zSiO_2$ | 1280 | Eitel 794 |
| $6CaO.2Al_2O_3.Fe_2O_3$ | 1365 | Eitel 1192 |
| FeO | 1369 | CRC |
| $xCaO.yAl_2O_3$ | 1400 | Eitel 730 |
| $4CaO.Fe_2O_3.Al_2O_3$ | 1412 | Eitel 1190 |
| $4CaO.Fe_2O_3.Al_2O_3$ | 1418 | CRC |
| $5CaO.B_2O_3.SiO_2$ | 1419 | Eitel 816 |
| $CaF_2$ | 1423 | CRC |
| CaS with $CaO.SiO_2$ | 1500 | Ward 100 |
| CaS with $CaO.Al_2O_3.2SiO_2$ | 1500 | Ward 100 |
| CaS with $2CaO.Al_2O_3.SiO_2$ | 1500 | Ward 100 |
| $CaO.SiO_2$ | 1540 | CRC |
| $CaO.Al_2O_3.SiO_2$ | 1551 | CRC |
| $CaO.Al_2O_3$ | 1600 | CRC |
| CaS with $CaO.SiO_2$ | 1650 | Ward 101 |
| CaS with $CaO.Al_2O_3.2SiO_2$ | 1650 | Ward 101 |
| CaS with $2CaO.Al_2O_3.SiO_2$ | 1650 | Ward 101. |

The following examples illustrate the flexibility of the current invention and a rational/non-limiting basis for choosing lime-flux combinations to achieve particular results.

EXAMPLE 1

Desulphurization

Thermodynamic calculations (e.g. JANAF free energy of reaction calculations based on free energy of formation data at elevated temperatures as described in reference 2) indicate that the chemical reactions described below are all feasible. Some of these reactions have been described in the references cited previously. The wholly or partially melted lime desulphurizes coal during combustion in a variety of ways, which operate sequentially, symbiotically or in parallel. In such a process molten lime adsorbs sulphur dioxide to form calcium sulphite, calcium sulphide and calcium sulphate according to the following:

$$FeS_2=FeS+1/2S_2$$

$$CaO+FeS=CaS+FeO$$

$$CaO+1/2S_2+C=CaS+CO$$

$$CaO+H_2S=CaS+H_2O$$

$$CaS+2O_2=CaSO_4$$

$$CaO+SO_2=CaSO_3$$

$$4CaSO_3=CaS+3CaSO_4$$

Molten lime reacts with sulphur species such as pyrite or elemental sulphur in the absence or presence of oxygen and in the absence or presence of carbon to form ferrous oxide, calcium sulphide, calcium sulphite, calcium sulphate and carbon monoxide. Note that the proper choice of lime-flux combinations (e.g. low viscosity and low melting points) allows flooding of coal or char particles especially during their devolatilization stage to effect numerous desulphurization reactions which do not require exclusively the $SO_2$ adsorption requirements of prior art technologies. FeO released from coal via $FeS_2$ pyrite decomposition or $FeCO_3$ siderite decomposition reduces "lime melt viscosity" due to lowering of the lime species melting point (see table 1) resulting in more rapid adsorption of hydrogen sulphide, sulphur dioxide, elemental sulphur, ferrous sulphide or pyrite adsorption by the melt. Note also that the substitution of liquid phase CaO chemistry instead of the prior art solid state CaO chemistry eliminates sintering issues and speed of reaction issues. It should be understood however that desulphurization reactions via $SO_2$ adsorption are possible upon freezing (solidification) of the lime-flux-ash-desulphurization product mixtures. Desulphurization efficiency will be a function of CaO/S ratios, coal volatiles content (i.e. char porosity), CaO melt chemistry including viscosity, plus combustor residence time and CaO/ash ratios which will control the levels of "free CaO" on freezing of the "product" melts.

EXAMPLE 2

Enhanced Coal Combustion and NOx Control

The reactions between molten lime and coal containing sulphur species described in Example 1 above are rapid and exothermic, since molten chemical species are in their ionized states, resulting in improved coal combustion even in the absence of oxygen or at lower than normal oxygen levels. The unique ability of molten lime containing mixtures to catalytically oxidize carbon in coal or char via calcium carbide $CaC_2$ formation guarantees enhanced coal combustion resulting in lower levels of unburned carbon under all combustion conditions including Low NOx combustor operation. The unique ability of molten CaO to provide the desirable CO required by NOx destruction reactions via its catalytic effect on catalytic coal or char carbon oxidation guarantees reduction in NOx levels. The ability of molten CaO to flood carbon-containing surfaces in chars guarantees maximization of CaO catalytic effects on NOx destruction.

EXAMPLE 3

Pozzolanic and Cementitious Materials

The output of Examples 1 and 2 above are clearly suited for pozzolanic and cementitious material production. The Zaitsev reference mentioned previously illustrates that it is possible to predict the crystal structure of frozen CaO-flux-ash mixtures. The production of $CaSO_4$ product from desulphurization reactions is compatible with pozzolanic/cementitious product end uses since this material is a common component in concrete and/or cement production. It is certain that the present method is highly flexible in the production of a wide variety of pozzolanic or cementitious materials via unique combinations of lime/flux chemistry, lime-flux-ash chemistry, lime-flux-ash-sulphur chemistry, lime/flux ratios, lime-flux/sulphur ratios, lime-flux/ash ratios and lime-flux/coal ratios. For instance, the molten alkaline lime-flux containing mixture can react with air to form a calcium sulphate containing byproduct or with coal ash to form mixtures of calcium aluminates, calcium silicates, calcium ferrates, calcium sulphate, calcium fluoroborates, calcium fluoroaluminates, calcium fluorosilicates, calcium fluorophosphates or their mixtures. These calcium salts become evident on cooling of the calcium-enriched reaction products of the fluxed lime and coal sulphur and ash species below their melting points (e.g. a molten $CaO.SiO_2$ species could freeze as $CaSiO_3$ for example). The alkalinity of the calcium enriched coal ash containing sulphur species such as calcium sulphate can be controlled unlike the prior art, merely by adjusting the lime to coal ash or lime to coal sulphur dosing ratio. In a sense this allows one to essentially titrate acidic coal species such as aluminum oxide, silicon dioxide, ferric oxide, sulphur dioxide etc. to form salts such as aluminates, silicates, ferrates, sulphoaluminates etc. with desirable properties for the production of concrete or cement. "Free lime" residual levels i.e. lime untitrated by acidic coal sulphur and ash species can be set to virtually any desirable level.

A unique feature of the current method is to use low-grade ash (e.g. land filled ash) as a component of the flux or as a fuel in combination with the fossil fuel e.g. coal or char. The advantage of this approach is that the pozzolanic or cementitious material of the combustor is no longer restricted to the ash content of the fossil fuel. This allows for a unique economical technique for the recovery and recycling of heretofore disposed metal containing ash waste.

EXAMPLE 4

Combustor Anti-Fouling Formulas

It is clear from the above examples and the background discussion that the current invention allows a degree of control with respect to prevention of combustor fouling due to "sticky" deposits at a level of control unavailable on a commercial scale by any known techniques. For instance a wide variety of lime-flux combinations can be chosen to modify the viscosity "stickiness" profile of particularly troublesome fossil fuels such as coals rich in iron species such as pyrite $FeS_2$ and/or $FeCO_3$ siderite. Molten CaO-flux mixtures have a unique ability to depolymerize the "silicate" chains in sticky deposits such as $xFeO—ySiO_2—zAl_2O_3$ implicated in combustor fouling. This feature is especially relevant to combustors attempting to run under low-NOx conditions and burning high sulphur fuels containing pyrite or siderite.

A non-exclusive list of materials able to melt lime, in whole or part, over a wide range of temperatures is given in the above table. Their choice could be made on either their ability to cause sulphur control, nitrogen oxides control, accelerated coal combustion, antifouling or enrich the calcium content of coal ash or both. These materials can be used alone or in an almost infinite number of desirable combinations. They can be derived alone or in combinations from both synthetic and natural sources. The calcium enriched ash products of this invention could be considered as lime fluxing agents in their own right.

Finally, even if the "fluxed lime" does not come in contact with the fossil fuel combustion ash (e.g. non-turbulent fossil fuel combustor), desulphurization is improved over the prior art. It is clear, however, that the maximum benefit of the current invention may be obtained under conditions where the lime plus lime fluxing additive come into intimate contact with the fossil fuel, e.g. coal or char, either by mixing them in their solid form prior to injection into the fossil fuel combustor, and/or by injecting them into a combustor with sufficient turbulence to cause collisions between the "fluxed lime" and the fossil fuel combustion ash.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

REFERENCES

1. Aarna, I. And E. M. Suuberg. 1999. The Role of Carbon Monoxide in the NO-Carbon Reaction. Energy and Fuels, 13:1145–1153.
2. Chase, M. W. et al. 1986. "JANAF Thermochemical Tables". Third Edition. Parts I and II. American Chemical Society and the American Institute of Physics (New York).
3. Edmunds, D. M. and J. Taylor. 1972. Reaction of $CaO+3C=CaC_2+CO$ and Activity of Lime in $CaO—Al_2O_3—CaF_2$ System. Journal of the Iron and Steel Institute, April, 210:280–284.
4. Eitel, W. The Physical Chemistry of the Silicates. University of Chicago Press (Chicago).
5. Eitel, W. 1966. Silicate Science. Academic Press (New York).
6. Fine. H. A. and D. R. Gaskell editors. 1984. "Second International Symposium on Metallurgical Slags and Fluxes". The Metallurgical Society of AIME.
7. Frady, W. T. 1999. South Carolina Electic and Gas Successful Application of Carbon Burn-Out at the Wateree Station. International Ash Utilization Symposium Commercial Ash Processing— a User's Perspective. http://www.electricfuels.com/cbopaper.html (pages 1 and 2)
8. Gopalakrishnan, R. et al. 1994. Catalysis of Char Oxidation by Calcium Minerals: Effects of Calcium Compound Chemistry on Intrinsic Reactivity of Doped Spherocarb and Zap Chars. Energy and Fuels, 8:984–989.
9. Gopalakrishnan, R. and C. H. Bartholomew. 1996. Effects of CaO, High-Temperature Treatment, Carbon Structure, and Coal Rank on Intrinsic Char Oxidation Rates. Energy and Fuels, 10:689–695.
10. Illán-Gómez, M. et al. 1995. NO Reduction by Activated Carbons 4. Catalysis by Calcium. Energy and Fuels, 9:112–118.
11. Malhotra, V. M. and P. K. Mehta. 1996. Advances in Concrete Technology. Volume 1. Pozzolanic and Cementitious Materials. Gordon and Breach Publishers (Canada).
12. McLennan, A. R. et al. 2000. Ash Formation Mechanisms During pf Combustion in Reducing Conditons. Energy and Fuels, 14:150–159.
13. McLennan, A. R. et al. 2000. An Experimental Comparison of the Ash Formed from Coals Containing Pyrite and Siderite Mineral in Oxidizing and Reducing Conditions. Energy and Fuels, 14:308–315.
14. Naik, T. et al. 1995. Properties of High Performance Concrete Systems Incorporating Large Amounts of High-Lime Fly Ash. Construction and Building Materials, 9(4) :195–204.
15. Ramme, B. 1999. Reburning of Coal Ash. U.S. Pat. No. 5,992,336, November 30.

16. Sarma, B. et al. 1996. Reduction of FeO in Smelting Slags by Solid Carbon: Experimental Results. Metallurgical and Materials Transactions B, Volume 27B, October, 717–730.

17. Simons, G. A. 1988. Parameters Limiting Sulfation by Cao. American Institute of Chemical Engineers Journal, 34(1), 167–170.

18. Song, Hyo-Soek et al. 1999. Thermodynamic Behaviour of Carbon in CaO—$Sio_2$ Slag System. Steel Research, 70(3):105–109.

19. Ueda, S. and M. Maeda. 1999. Phase Diagram Study for the $Al_2O_3$—$CaF_2$—$SiO_2$ system.

20. Ward, R. G. 1962. An Introduction to the Physical Chemistry of Iron and Steel Making. Edward Arnold Publishers (London).

21. Zaitsev et al. 1997. Thermodynamic Properties and Phase Equilibria in the $CaF_2$—$SiO_2$—$Al_2O_3$—CaO System:II. Thermodynamic Modelling of $CaF_2$—$SiO_2$—$Al_2O_3$—CaO Melts. Inorganic Materials, 34(1):80–88.

22. Zaitsev et al. 1997. Thermodynamics of CaO—$Al_2O_3$—$SiO_2$ and $CaF_2$—CaO—$Al_2O_3$—$SiO_2$ Melts. Journal of the Chemical Society, Faraday Transactions, 1997, 93(17):3089–3098.

23. Zhang, Z. -G. 1994. Successive Pulsing of an Iron-Loaded Canadian Subbituminous Coal Char. Energy and Fuels, 8:943–946.

24. Waseda, W. and J. Toguri. 1998. The Structure and Properties of Oxide Melts. Application of Basic Science to Metallurgical Processing. World Scientific (London).

25. Weast, R. W. and M. J. Astle editors. 1982. CRC Handbook of Chemistry and Physics. $63^{rd}$ edition.

We claim:

1. A method of treating fossil fuel for combustion, comprising:

heating a fossil fuel which contains ash and an additive in a combustion zone together with lime, wherein the additive contains a lime flux that lowers the melting point of said lime sufficiently so that said lime melts, wholly or partially.

2. The method as claimed in claim 1, wherein the said fossil fuel contains sulphur species wherein said sulphur species are selected from the group consisting of sulphur dioxide, sulphites, sulphides, and sulphur.

3. The method as claimed in claim 1, wherein the additive contains lime.

4. The method as claimed in claim 1, wherein the additive contains a boron substance.

5. The method as claimed in claim 2, wherein the additive reacts with at least one of said sulphur species in said combustion zone.

6. The method as claimed in claim 1, wherein the additive causes reduction in $NO_x$ emissions, where $NO_x$ is $N_2O$ or NO.

7. The method as claimed in claim 1, wherein the additive causes accelerated coal combustion.

8. The method as claimed in claim 1, wherein the additive causes a reduction in combustor fouling due to sticky deposits.

9. The method as claimed in claim 1, wherein the additive causes formation of pozzolanic or cementitious by-products.

10. The method as claimed in claim 4, wherein the boron substance is a borate.

11. The method as claimed in claim 4, wherein the borate is a calcium borate.

12. The method as claimed in claim 1, wherein the additive contains an iron substance.

13. The method as claimed in claim 12, wherein the iron substance is an iron sulphide.

14. The method as claimed in claim 12, wherein the iron substance is an iron disulphide.

15. The method as claimed in claim 12, wherein the iron substance is selected from the group consisting of an iron ferrite, iron ferrate and iron carbonate.

16. The method as claimed in claim 12, wherein the iron substance is an iron oxide.

17. The method as claimed in claim 16, wherein the iron oxide is ferrous oxide.

18. The method as claimed in claim 16, wherein the iron oxide is ferric oxide.

19. The method as claimed in claim 1, wherein the additive has a phosphorus component.

20. The method as claimed in claim 19, wherein said phosphorus component is a phosphate.

21. The method as claimed in claim 19, wherein said phosphorus component is a pyrophosphate.

22. The method as claimed in claim 1, wherein the additive contains a silicon substance.

23. The method as claimed in claim 1, wherein the additive contains an oxide of silicon.

24. The method as claimed in claim 23, wherein said oxide of silicon is silicon dioxide.

25. The method as claimed in claim 22, wherein said silicon substance is a silicate.

26. The method as claimed in claim 1, wherein the additive contains an aluminum substance.

27. The method as claimed in claim 26, wherein the aluminum substance is aluminum oxide.

28. The method as claimed in claim 26, wherein the aluminum substance is an aluminate.

29. The method as claimed in claim 1, wherein the additive contains a fluorine substance.

30. The method as claimed in claim 29, wherein the fluorine substance is a fluoride.

31. The method as claimed in claim 29, wherein the fluorine substance is selected from the group consisting of a fluorosilicate, a fluoroaluminate, a fluoroborate and a fluorophosphate.

32. The method as claimed in claim 1, wherein said additive contains a sulphur substance.

33. The method as claimed in claim 32, wherein the sulphur substance is selected from the group consisting of sulphide and disulphide.

34. The method as claimed in claim 32, wherein the sulphur substance is a sulphate.

35. The method as claimed in claim 32, wherein the sulphur substance is a sulphoaluminate.

36. The method as claimed in claim 1, wherein the additive is injected into the combustion zone.

37. The method as claimed in claim 36, wherein the additive is added to said lime as a solid.

38. The method as claimed in claim 36, wherein the additive is added to the lime in molten form and then allowed to freeze before furnace injection.

39. The method as claimed in claim 36, wherein said lime flux is added to the lime in molten form to form a combined form and then the combined form is injected with lime into the combustion zone in a partially or wholly molten state.

40. The method as claimed in claim 37, wherein the additive is mixed with the fossil fuel before furnace injection.

41. The method as claimed in claim 38, wherein the additive is mixed with the fossil fuel before furnace injection.

42. The method as claimed in claim 1, wherein said fossil fuel contains coal or char.

43. The method according to claim 36, including adjusting a lime-to-coal ash or a lime-to-coal sulphur ratio to obtain a selected alkalinity of calcium enriched coal ash.

44. A method according to claim 1, including injecting steam into a combustion zone or post-combustion zone.

45. A calcium enriched fossil fuel derived ash produced according to the process of claim 1.

46. A calcium enriched fossil fuel derived ash as produced according to claim 1, wherein said ash is a pozzolan.

47. A calcium enriched fossil fuel derived ash as produced according to claim 36, wherein said ash is a pozzolan.

48. A calcium enriched fossil fuel derived ash as produced according to claim 38, wherein said ash is a pozzolan.

49. A calcium enriched fossil fuel derived ash as produced according to claim 39, wherein said ash is a pozzolan.

50. A calcium enriched fossil fuel derived ash as produced according to the process of claim 1, wherein said ash has cementitious properties.

51. A calcium enriched fossil fuel derived ash as produced according to the process of claim 36, wherein said ash has cementitious properties.

52. A calcium enriched fossil fuel derived ash as produced according to the process of claim 38, wherein said ash has cementitious properties.

53. A calcium enriched fossil fuel derived ash as produced according to the process of claim 39, wherein said ash has cementitious properties.

* * * * *